US008308159B1

(12) United States Patent
Manor et al.

(10) Patent No.: US 8,308,159 B1
(45) Date of Patent: Nov. 13, 2012

(54) MULTI-PLANED MEDIA ALIGNER

(75) Inventors: Adam Thomas Manor, Lexington, KY (US); Richard Winston Thomas, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 13/243,610

(22) Filed: Sep. 23, 2011

(51) Int. Cl.
*B65H 9/00* (2006.01)

(52) U.S. Cl. ..... 271/245; 271/226

(58) Field of Classification Search ..... 271/3.02, 271/121, 122, 226, 233, 234, 235, 236, 238, 271/239, 243, 245, 246, 247, 271
See application file for complete search history.

(56) References Cited

U.S. PATENT DOCUMENTS 229,998 A * 7/1880 Goss ..... 271/238
3,948,170 A * 4/1976 Ericsson ..... 101/124
4,341,299 A * 7/1982 Walker et al. ..... 198/434
4,638,989 A * 1/1987 Senoo ..... 271/227
4,641,742 A * 2/1987 Igarashi et al. ..... 198/626.5
5,074,545 A * 12/1991 Handa ..... 271/227
7,128,317 B2 * 10/2006 Johnson et al. ..... 271/121
2003/0184003 A1 * 10/2003 Asada et al. ..... 271/121
2005/0051945 A1 * 3/2005 Kang ..... 271/121

FOREIGN PATENT DOCUMENTS

JP 04075946 A * 3/1992

* cited by examiner

*Primary Examiner* — Jeremy R Severson
(74) *Attorney, Agent, or Firm* — John Victor Pezdek

(57) ABSTRACT

An apparatus for aligning a media sheet includes a sheet feed system for transporting the media sheet along a media feed path in a media feed direction and an alignment assembly is positioned to intersect the media feed path. The alignment assembly includes a deflectable member having a plurality of sets of arms, each of the arms of each set has a contact surface defining a plane unique to each set of arms. The media sheet aligns as it exerts a media engagement force on the alignment assembly and causes the alignment assembly to deflect when the media engagement force exceeds the aligning force.

20 Claims, 9 Drawing Sheets

MULTI-PLANED MEDIA ALIGNER

CROSS REFERENCES TO RELATED APPLICATIONS

None

STATEMENT REGARDING FEDERALLY SPONSORED RESEARCH OR DEVELOPMENT

None

REFERENCES TO SEQUENTIAL LISTING, ETC

None

BACKGROUND

1. Field of the Invention

The present invention relates to transporting a media sheet, and, more particularly, to an apparatus for aligning the media sheet.

2. Description of the Related Art

Imaging apparatus, such as a printer, include a media path for moving a media sheet from an input area, through an imaging area, and ultimately to an output area that is usually on an exterior of the apparatus. The media path includes a plurality of nips formed between opposing rolls that not only drive a media sheet along the media path but may also facilitate the alignment of the media sheet prior to reaching the imaging area to ensure that the images are positioned correctly on the media sheet. A misaligned media sheet at the imaging area may result in a print defect commonly referred to as skew.

Various types of sheet registration systems have been used to align a media sheet in a media path of an imaging apparatus. One common sheet registration system is one in which the media is aligned to the media's side edge by forcing the media against a continuous solid edge that is aligned perpendicular to the imaging unit and is parallel to the media path. This is typically called a reference edge alignment system. Another method is to align the leading edge of the sheet by buckling the leading edge of the media sheet until it reaches proper alignment such that the leading edge is parallel to the imaging unit and is perpendicular to the media path. This is typically called a center-fed alignment system.

The most common method to achieve center-fed alignment is the use of a spring loaded alignment assembly, also known as a deskew shutter. The alignment assembly typically has a plurality of pairs of arms that stop one side of the media sheet just long enough for the other side to align before the full width of the media sheet forces the alignment assembly to retract or rotate out of the way. This stalling of the leading edge allows media to align with the alignment assembly prior to imaging. This type of alignment has been referred to as a bump-align method. In this method, the media sheet can only best be aligned to the alignment assembly's contacting surfaces, so keeping these contacting surfaces in line with each other as well as aligned to the imaging apparatus is most critical. Further, the number of contacting surfaces in an alignment assembly varies depending on the sizes of media supported by the printer. For best results, the media sheet's leading edge should only contact the appropriate pair of arms, and these two contact points should be as far from each other as allowed by the media sheet's width. If standard narrow media sheet sizes are supported, there is typically a need to have six or more contacting surfaces. From a manufacturing standpoint, it becomes most difficult to keep all contacting surfaces in line with each other using conventional manufacturing processes (e.g. molding, over molding, etc.) and tolerances. This can lead to situations where the two contact points may not be the outermost contacting surfaces, resulting to a less than ideal alignment.

What is needed in the art is an apparatus for aligning media sheet that guarantees that the media sheet is contacting the appropriate outermost pair of arms for aligning the media sheet based on the media sheet size.

SUMMARY OF THE DISCLOSURE

An example embodiment of the disclosure relates to an apparatus for aligning a media sheet. The apparatus includes a support, a sheet feed system for transporting the media sheet along a plane of a media feed path in a media feed direction, and an alignment assembly coupled to the support and positioned to intersect the media feed path. The alignment assembly applies an aligning force to the media sheet being transported and includes a deflectable member having a plurality of sets of arms extending therefrom into the plane of the media feed path. Each set of arms is comprised of at least two spaced apart and aligned arms and each of the at least two arms has a contact surface defining a plane unique to each set of arms. The contact between each of the at least two arms and the media sheet being transported aligns the media to the plane of the at least two arms. The alignment assembly also includes a biasing member coupled between the deflectable member and the support, the biasing member for providing the aligning force in a direction opposite the media feed direction. The media sheet being transported exerts a media engagement force against the at least two arms of a set and in so doing, the media sheet aligns. When the media engagement force exceeds the aligning force, the media sheet causes the alignment assembly to deflect and the media sheet passes the alignment assembly. The deflectable member includes a first set of arms defining a first plane, and a second set of arms defining a second plane and positioned between the first set of arms wherein the second plane is positioned downstream of the first plane relative to the media feed path. The sheet feed system is selectable to transport one media sheet having a first width and another media sheet having a second width less than the first width, wherein a spacing between the arms of the first set is selected to be less than the first width of the one media sheet and greater than the second width of the another media sheet, and wherein a spacing between the arms of the second set is selected to be less than the second width of the another media sheet. Each of the first set of arms is positioned at each end of the first width of the one media sheet, and each of the second set of arms is positioned at each end of the second width of the other media sheet. The deflectable member may further include a third set of arms defining a third plane and positioned between the second set of arms, the third plane being positioned downstream of the second plane. The sheet feed system is further selectable to transport a further media sheet having a third width less than the second width of the other media sheet, wherein a spacing between the arms of the third set is selected to be less than the third width of the further media sheet, and wherein each of the third set of arms is positioned at each end of the third width of the further media sheet.

In another example embodiment, an apparatus for aligning a media sheet includes an alignment assembly having a deflectable member, the deflectable member having a plurality of sets of at least one arm extending therefrom, each set of at least one arm having at least one contact surface defining a plane unique to each set of at least one arm, and a biasing member coupled between the deflectable member and the support, the biasing member for providing the aligning force in a direction opposite the media feed direction. When the media sheet being transported exerts a media engagement force against the set of at least one arm, the media sheet aligns; and when the media engagement force exceeds the aligning force, the media causes the alignment assembly to deflect and the media sheet passes the alignment assembly.

In another example embodiment, an imaging apparatus includes an alignment assembly mounted to a support, the alignment assembly extending across the media feed path and forming a shallow V with a point of the V in a downstream direction in relation to the media feed path. The alignment assembly includes a plurality of pairs of arms spaced apart from one another across the media feed direction. An arm of one pair is positioned to align to another arm of the one pair on the opposite side of the V, each of the plurality of pairs of arms defining a unique plane therebetween. The alignment assembly also includes a biasing spring connected to a midpoint of the alignment assembly on one end and a support on another end, the biasing spring for biasing the alignment assembly in a direction counter to the media feed direction. The media sheet being transported exerts a media engagement force against one pair of arms, the media sheet aligning; and when the media engagement force exceeds the aligning force, the media sheet causes the alignment assembly to deflect and the media sheet passes the alignment assembly.

BRIEF DESCRIPTION OF DRAWINGS

The above-mentioned and other features and advantages of this invention, and the manner of attaining them, will become more apparent and the invention will be better understood by reference to the following description of embodiments of the invention taken in conjunction with the accompanying drawings.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1:
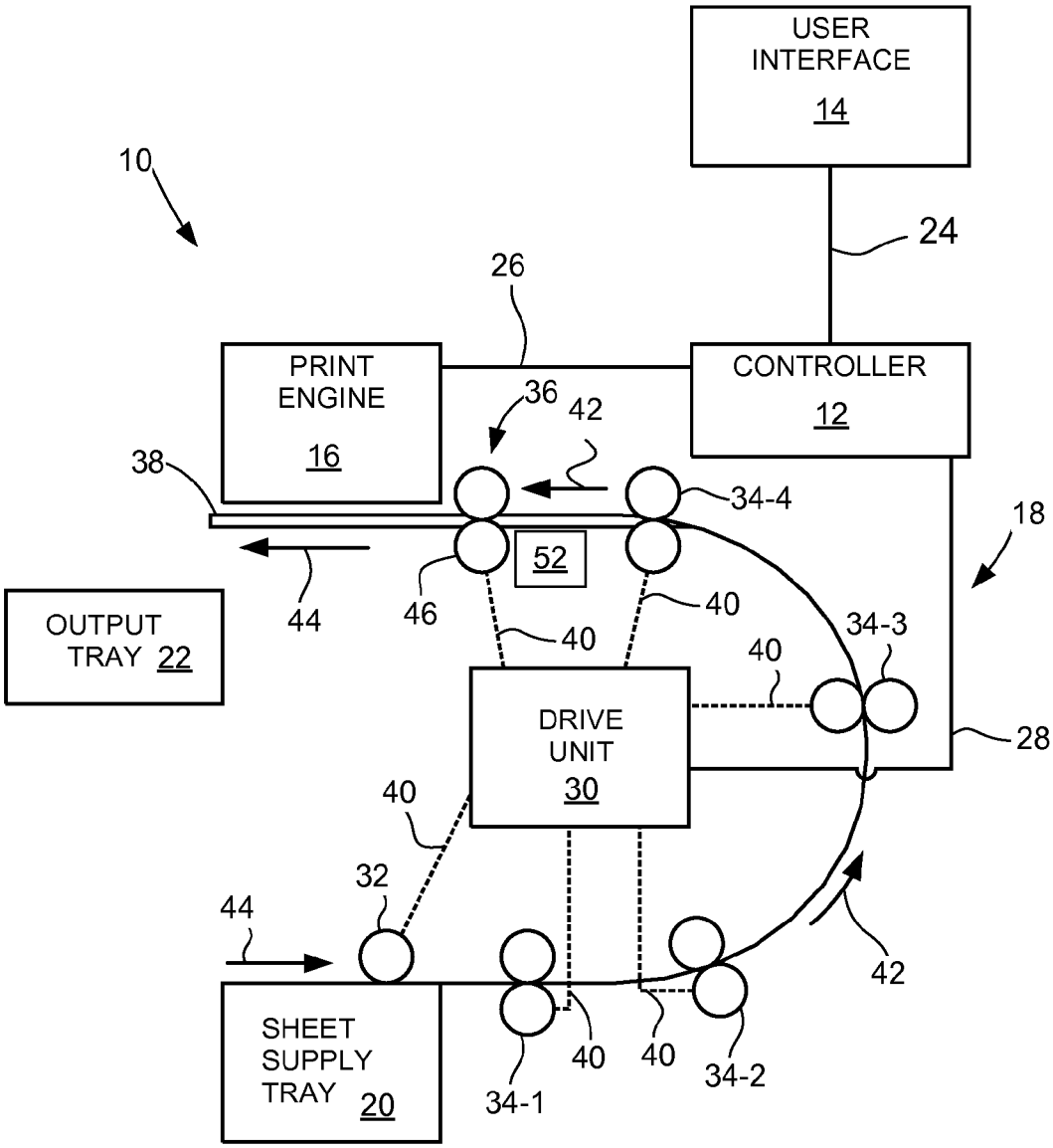
FIG. 1 is a schematic illustration of an imaging system embodying the present invention.

Referring now to the drawings and particularly to FIG. 1, there is shown an imaging apparatus 10 embodying the present invention. In the present invention, imaging apparatus 10 includes a controller 12, a user interface 14, a print engine 16, a sheet feed system 18, a sheet supply tray 20 for holding a supply media, and a sheet output tray 22 for receiving media sheets that have been printed.

Imaging apparatus 10 is a machine that is capable of generating a printed output. Examples of machines that may be represented by imaging apparatus 10 include a printer, a copying machine, and a multifunction machine that may include standalone copying and facsimile capabilities, in addition to optionally serving as a printer when attached to a host computer.

Controller 12 of imaging apparatus 10 includes a processor unit and associated memory, and may be formed as an Application Specific Integrated Circuit (ASIC). Controller 12 communicates with user interface 14 via a communications link 24. Controller 12 communicates with print engine 16 via a communications link 26. Controller 12 communicates with sheet feed system 18 via a communications link 28. Each of communications links 24, 26 and 28 may be established, for example, by using one of a standard electrical cabling or bus structure, or by a wireless connection.

User interface 14 may include buttons for receiving user input, such as for example, power on, or print media tray selection. User interface 14 may also include a display screen for displaying information relating to imaging apparatus 10, such as for example, print job status information.

Print engine 16 may be electrophotographic print engine of a type well known in the art, and may include, for example, a laser light source module, a light scanning device, a photoconductive substrate, a developer unit and a fuser unit. The photoconductive substrate may be, for example, a rotating photoconductive drum of a type well known in the electrophotographic imaging arts, and may be formed as a part of an imaging cartridge that includes a supply of toner.

Sheet feed system 18 includes a drive unit 30 communicatively coupled to controller 12 by communications link 28. Drive unit 30 includes one or more motors, such as a DC motor or a stepper motor. Sheet feed system 18 includes, for example, a sheet picker 32, transport roller pairs 34-1, 34-2, 34-3 and 34-4, an input roller pair 36 and a main frame 38. Each pair of rollers 34-1, 34-2, 34-3, 34-4, and 36 may include a driven roller, and a backup roller. The driven rollers of sheet picker 32, transport roller pairs 34-1, 34-2, 34-3 and 34-4, an input roller pair 36 are drivably coupled to one or more drive mechanisms 40, represented by dashed lines. Drive mechanisms 40 may be, for example, a gear arrangement and/or a belt-pulley arrangement, as is known in the art.

During operation, at the directive of controller 12, drive unit 30 and drive mechanisms 40 are actuated such that a media sheet is picked by sheet picker 32 from sheet supply tray 20, and transported by transport roller pairs 34-1, 34-2, 34-3 and 34-4 along a media feed path 42 in media feed direction 44 toward input roller pair 36. Sheet feed system 18 may be configured as a center-fed system, meaning that a media sheet is centered on media feed path 42, regardless of the width of the media sheet. Near the location of input roller pair 36, an alignment assembly 52 is provided in the media feed path 42 for aligning the media sheet in accordance with the present invention, prior to being received by print engine 16.

Figure 2:
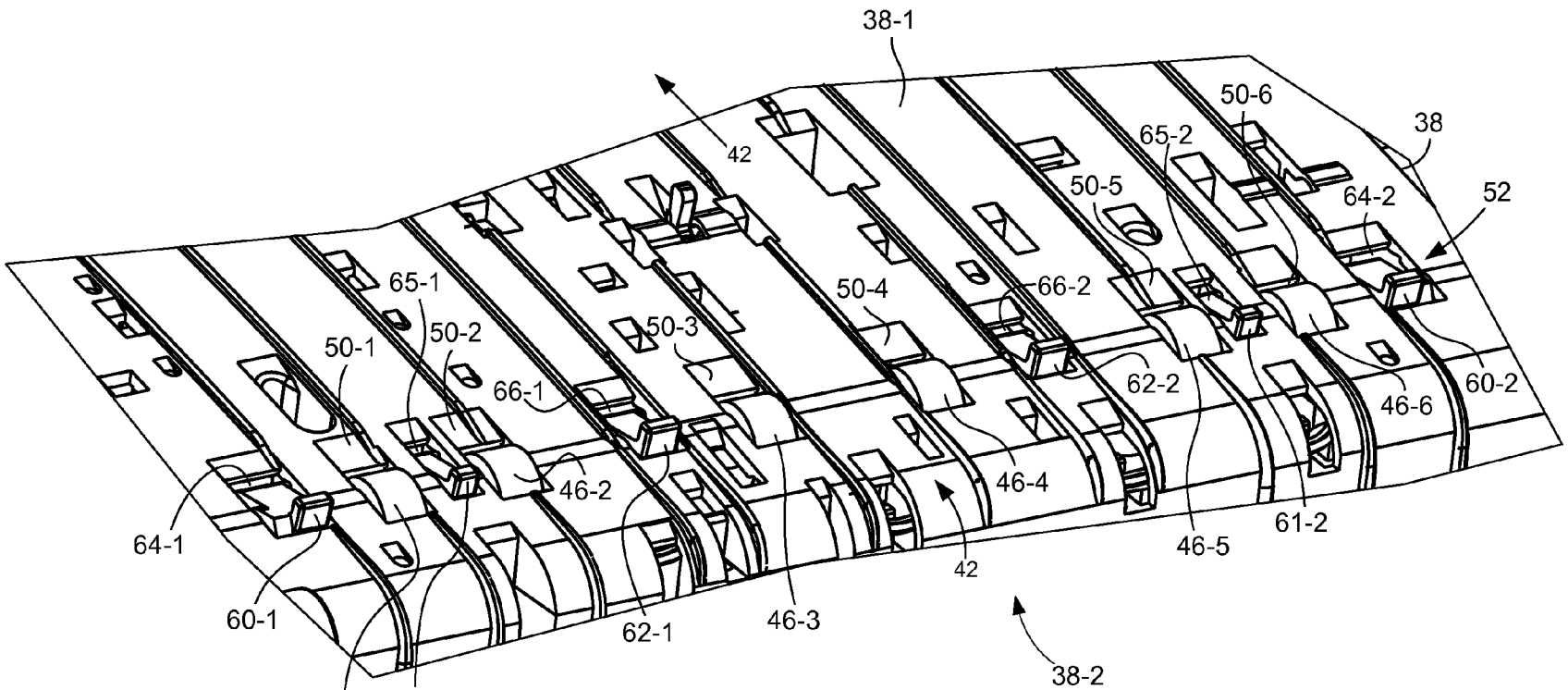
FIG. 2 is a partial top perspective view of a portion of a main frame having coupled thereto an alignment assembly of the imaging system of FIG. 1.
Figure 3:
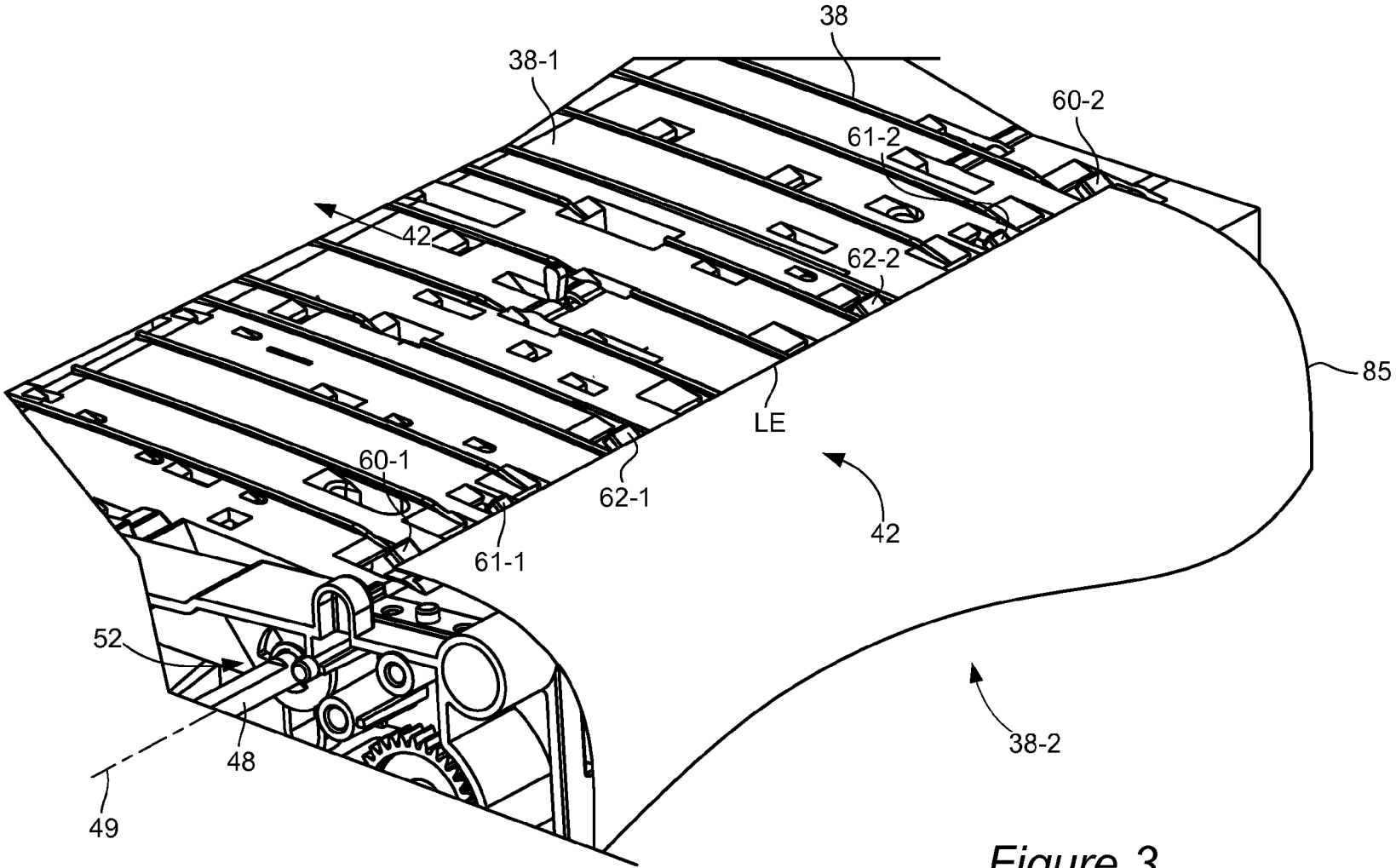
FIG. 3 is a partial top perspective view of a portion of a main frame having coupled thereto an alignment assembly, and showing the engagement of the alignment assembly by a media sheet.

Referring to FIGS. 2 and 3, there is shown a top perspective view of main frame 38. Main frame 38 includes a sheet supporting surface (upper side) 38-1 and an under side 38-2. Input roller pair 36 includes a driven input roller 46 having segmented rollers 46-1, 46-2, 46-3, 46-4, 46-5 and 46-6 spaced apart and fixedly mounted to a shaft 48. Shaft 48 is rotatably mounted to underside 38-2 of main frame 38, and defines a rotational axis 49. Main frame 38 includes a plurality of openings 50-1, 50-2, 50-3, 50-4, 50-5 and 50-6 configured for receiving and exposing a portion of segmented rollers 46-1, 46-2, 46-3, 46-4, 46-5, and 46-6 above the plane of sheet supporting surface 38-1 of main frame 38. In FIG. 3, there is shown a portion of alignment assembly 52 positioned to intersect the media feed path 42. It also shows a leading edge LE of a media sheet 85 engaging the alignment assembly 52. Main frame 38 also includes a plurality of openings 64-1, 64-2, 65-1, 65-2, 66-1, and 66-2 for respectively receiving and exposing a portion of arms 60-1, 60-2, 61-1, 61-2, 62-1, and 62-2 above the plane of sheet supporting surface 38-1 of main frame 38 (shown in FIG. 2).

Figure 4:
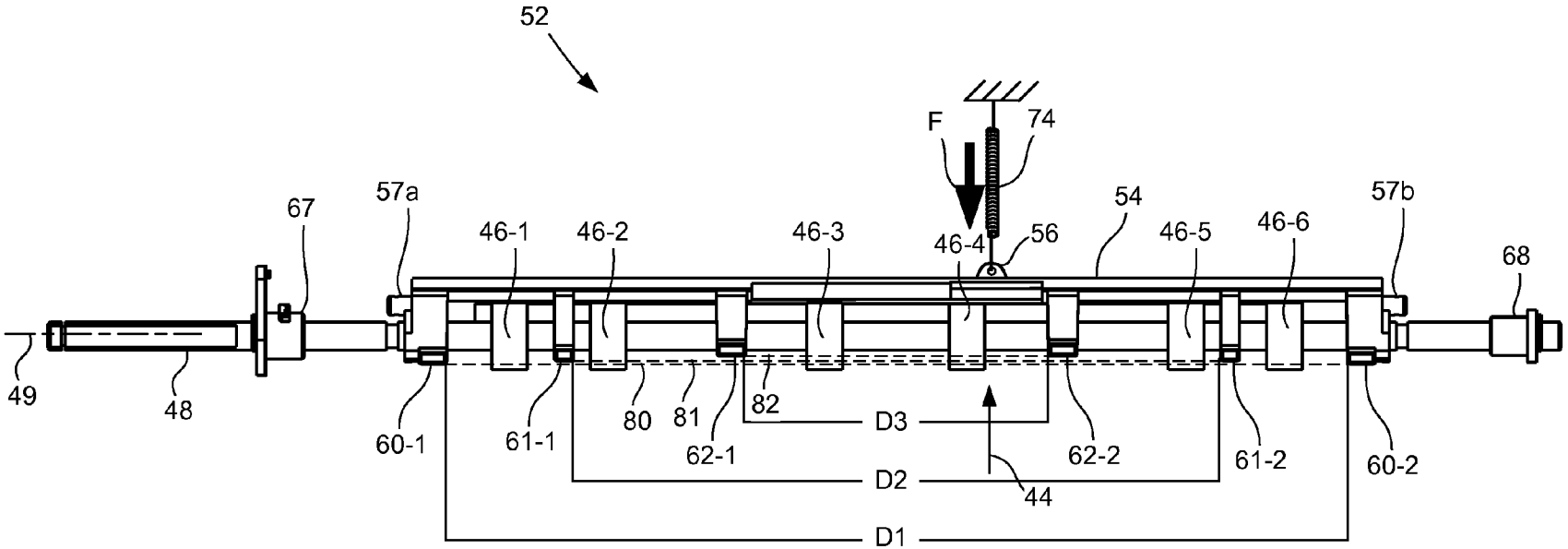
FIG. 4 is a top view of the alignment assembly with the main frame removed.
Figure 5:
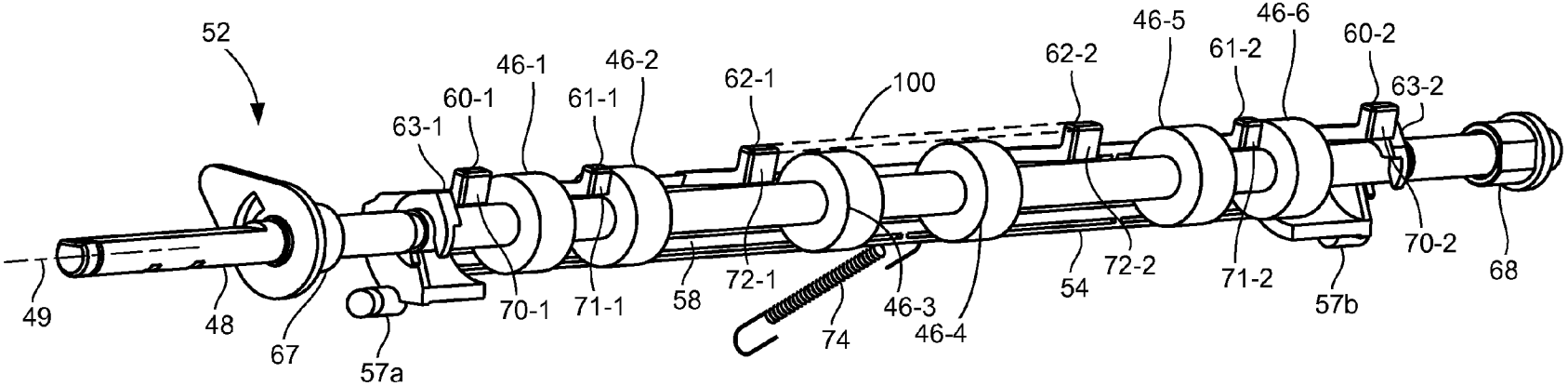
FIG. 5 is perspective view of the alignment assembly with the main frame removed.

As shown in FIGS. 4 and 5, the alignment assembly 52 includes a deflectable member 54 and a biasing spring 74. Biasing spring 74 has one end attached at attachment tab 56 projecting from near the midpoint of deflectable member 54 and the other end attached to a support (not shown) and provides a biasing force F indicated by the arrow opposite to the media feed direction 44. In one alternative embodiment, the alignment assembly 52 includes a first biasing spring (not shown) having one end attached to an attachment post 57*a* projecting near the distal end of deflectable member 54 and a second biasing spring (not shown) having one end attached to an attachment post 57*b* projecting near the opposite distal end of deflectable member 54. Each of the first and second biasing springs has an opposite end attached to a support (not shown). The support may be main frame 38 or another attachment point such as a support for an idler or feed roll. Deflectable member 54 includes a body 58 having a plurality of pairs of arms 60-1, 60-2, 61-1, 61-2, 62-1, 62-2 extending therefrom, interspersed among rollers 46-1-46-6, and positioned about a centerline of the media path 42. A first set or pair of arms includes arms 60-1 and 60-2 wherein arm 60-1 is spaced apart from arm 60-2 by a distance D1. A second set or pair of arms includes arms 61-1 and 61-2 wherein arm 61-1 is spaced apart from arm 61-2 by a distance D2. A third set or pair of arms includes arms 62-1 and 62-2 wherein arm 62-1 is spaced apart from arm 62-2 by a distance D3. Alternatively, instead of a third set or pair of arms, deflectable member 54 may include a single arm, indicated by dashed lines 100, having a width slightly greater than or equal to the distance D3. Further, if desired, more sets or pairs or arms may be added to body 58 to accommodate more media sheet sizes, wherein one pair of arms is added for each additional media size. A C-clip attachment feature 63-1, 63-2 is formed at opposing ends of body 58 to facilitate the rotatable attachment of deflectable member 54 to shaft 48 of driven input roller 46. In one example embodiment, the alignment assembly 52 is rotatably supported near its distal ends by bushings 67, 68. Bushing 67 may have a locking feature (not shown) such as a post adapted to fit in a slot (not shown) in the main frame 38 to fixably secure the alignment assembly 52.

Figure 6:
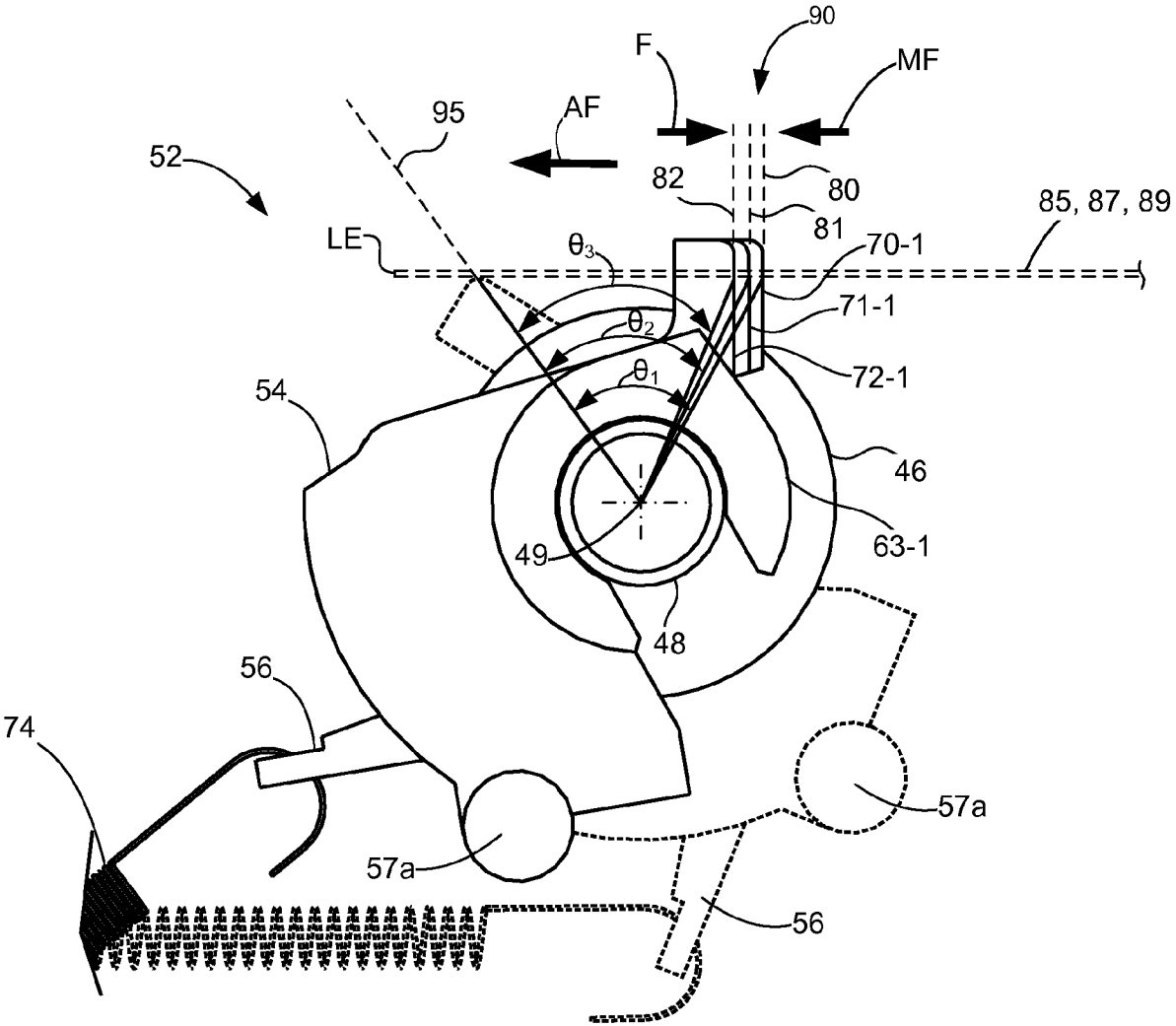
FIG. 6 is a side view of the alignment assembly with the main frame removed.

Referring to FIGS. 4, 5 and 6, each set or pair of arms 60-1 and 60-2, 61-1 and 61-2, and 62-1 and 62-2 extending from deflectable member 54 each have contact surfaces (see FIG. 5) aligned to a plane unique to each set or pair of arms. Arm 60-1 of the first set or pair has a contact surface 70-1 aligned (shown in broken line) to the contact surface 70-2 of arm 60-2. The contact surfaces 70-1 and 70-2 define a first plane 80 (shown in dashed lines in FIG. 4). Arm 61-1 of the second set or pair has a contact surface 71-1 aligned to the contact surface 71-2 of arm 61-2. The contact surfaces 71-1 and 71-2 define a second plane 81 (shown in dashed lines in FIG. 4) which is positioned downstream of the first plane 80 relative to the media feed direction 44. Arm 62-1 of the third set or pair has a contact surface 72-1 aligned to the contact surface 72-2 of arm 62-2. The contact surfaces 72-1 and 72-2 define a third plane 82 (shown in dashed lines in FIG. 4) which is positioned downstream of the second plane 81 relative to the media feed direction 44. As shown in FIG. 4, the deflectable member 54 extends across the media feed path 42 and forms a shallow V with a point of the V in a downstream direction in relation to the media feed path 42. As explained in greater detail below, this ensures that any given media size will only contact the outermost set or pair of arms intended for its width. Further, from a manufacturing standpoint, it becomes easier to keep two surfaces in line than it is to keep all six (or five) surfaces in line.

Alignment assembly 52 is configured in a shutter-like arrangement, with deflectable member 54 configured to pivot about rotational axis 49. A biasing spring 74 is coupled between deflectable member 54 and main frame 38 to exert a biasing force F illustrated in FIG. 6. In this example embodiment, only one biasing spring 74 is provided and is coupled at one end to the deflectable member 54 approximately midway along a length of the deflectable member 54 and at the other end to the main frame 38. Positioning the biasing spring 74 midway along the length of the deflectable member 54 allows for a symmetric deflection of the alignment assembly 52 from a home position 90. This may also be done by providing a biasing member at each end of deflectable member 54. The media sheet being transported exerts a media engagement force MF against arms of a given set or pair and in so doing the media sheet deskews or aligns to the plane defined by the contacting surfaces of the given set or pair of arms. In this case, the biasing force F is equal to the media engagement force MF which is in a direction opposite the media feed direction 44. If two or more biasing members are used to provide the biasing force F, the media engagement force MF is equal to the sum of the biasing forces provided by each biasing member. When the media sheet exerts a force that exceeds the media engagement force MF, the deflectable member 54 deflects or rotates out of the media path 42, wherein the total or final force exerted by the media sheet is termed an alignment force AF.

As shown in FIG. 6, the angular distance θ traveled by each contact surface from the home position 90 to the deflected position 95 varies because for each contact surface, the leading edge LE of the media sheets 85, 87, or 89 contact the deflectable member 54 at different points corresponding to the plane of the contact surface. For example, contact surface 72-1 may be positioned downstream of contact surface 71-1 relative to the media feed direction 44, such that the angular distance $\theta_3$ that the deflectable member 54 has to travel from third plane 82 to reach the deflected position 95 is less than the angular distance $\theta_2$ that the deflectable member 54 has to travel from second plane 81 to reach the deflected position 95. Similarly, the angular distance $\theta_2$ that the deflectable member 54 has to travel from second plane 81 to reach the deflected position 95 is less than the angular distance $\theta_1$ that the deflectable member 54 has to travel from first plane 80 to reach the deflected position 95. As a result, although the magnitude of the media engagement force MF on the media sheet is the same as the biasing force F of biasing member 74, the aligning force AF would vary depending on which pair of arms is contacted by the leading edge LE of the media sheet. Stated differently, the amount of stretch of the biasing member 74 which is proportional to the aligning force AF would vary depending on the angular distance θ that the deflectable member 54 has to travel from the home position 90 to the deflected position 95. This provides the additional advantage of varying the aligning force AF based on the media sheet size because a wider media sheet requires a greater aligning force AF than a narrower media sheet. Typically, a narrower media sheet will be less stiff than a wider media sheet, and thus would be more difficult to align without incurring a jam in the media feed path 82 if the aligning force AF is more than the media sheet can handle.

Referring to FIGS. 4, 7A, 7B, and 7C the spacing distance D1 between arm 60-1 and arm 60-2 is selected to be less than a width W1 of a wider media sheet 85, and greater than a width W2 of a relatively narrower or medium width media sheet 87. The spacing distance D2 between arm 61-1 and arm 61-2 is selected to be less than the width W2 of the medium width media sheet 87, and greater than a width W3 of an even narrower media sheet 89. The spacing distance D3 between arm 62-1 and arm 62-2 is selected to be less than the width W3 of the narrower media sheet 89. Width W1 is greater than width W2 and width W2 is greater than width W3. Media sheet 85 may be, for example, one of A4 and letter size media. Media sheet 87 may be, for example, A5 media. Media sheet 89 may be, for example, A6 media. When pairs of contacting arms are used, the farther apart the contacting arms are, or said in another way, the closer the arms are to the side edges of the media sheet being deskewed, the smaller the effect of any misalignment between the contacting surfaces will be on deskewing performance.

Figure 7A:
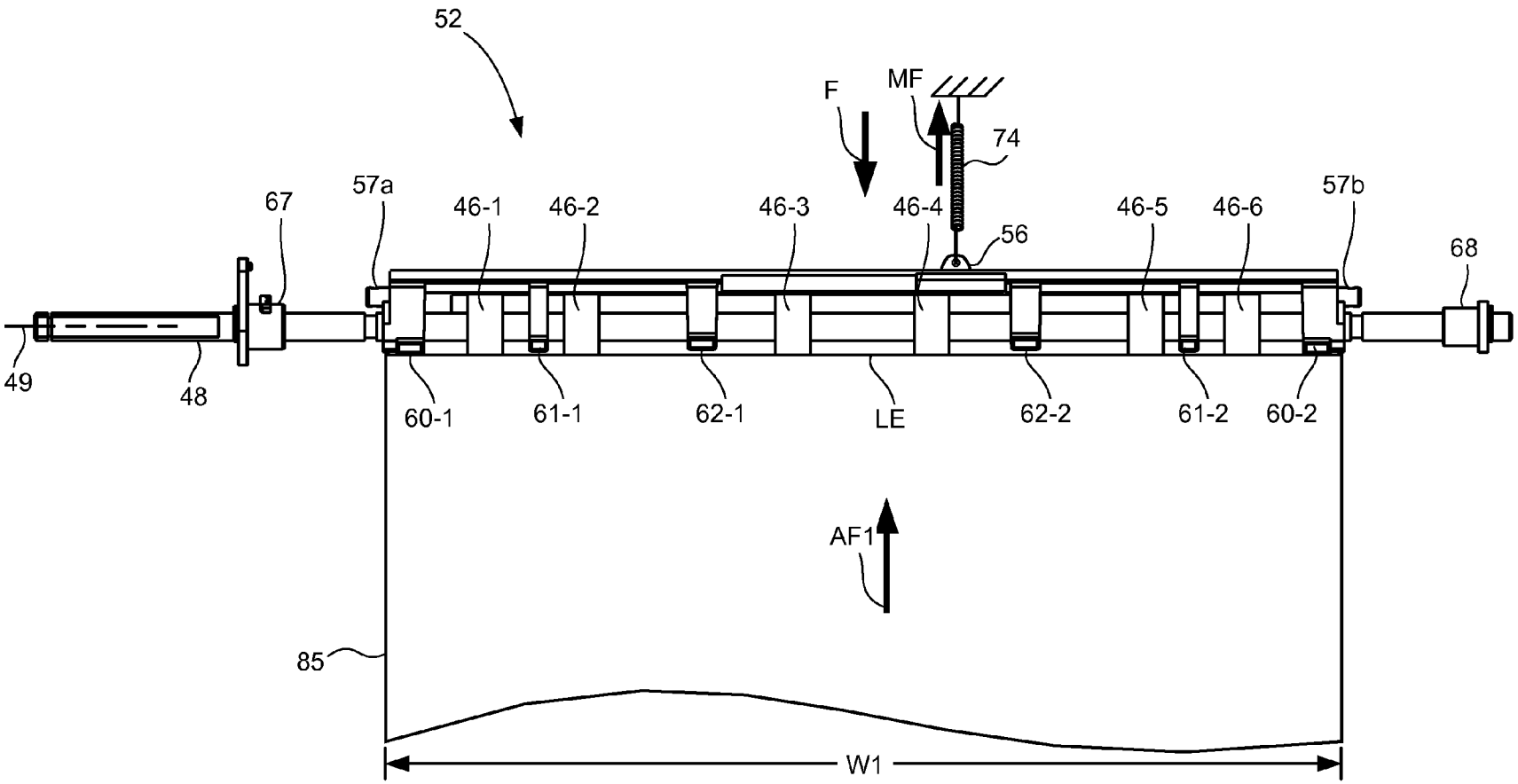
FIG. 7A is a top view of the alignment assembly with the main frame removed, and showing the engagement of the alignment assembly by a wide media.

FIG. 7A demonstrates a scenario wherein wider media sheet 85, having a width W1 in the direction transverse to media feed direction 44, will engage arms 60-1 and 60-2 but not arms 61-1, 61-2, 62-1 and 62-1, and must overcome the biasing force F exerted by biasing spring 74 in order to deflect alignment assembly 52 due to the shutter-like arrangement of alignment assembly 52 described above. Width W1 is greater than distance D1 (see FIG. 2). When wider media sheet 85 is transported by sheet feed system 18 to engage alignment assembly 52, alignment assembly 52 resists forward conveyance of media sheet 85 in media feed direction 44 (to align wider media sheet 85) until an aligning force AF1 exerted by wider media sheet 85 overcomes the media engagement force MF exerted by the biasing spring 74, at which time, each of the arms 60-1, 60-2, 61-1, 61-2, 62-1 and 62-2 is deflected from the home position 90 to deflected position 95 (shown in FIG. 6) below media feed path 42 to allow wider media sheet 85 to pass.

Figure 7B:
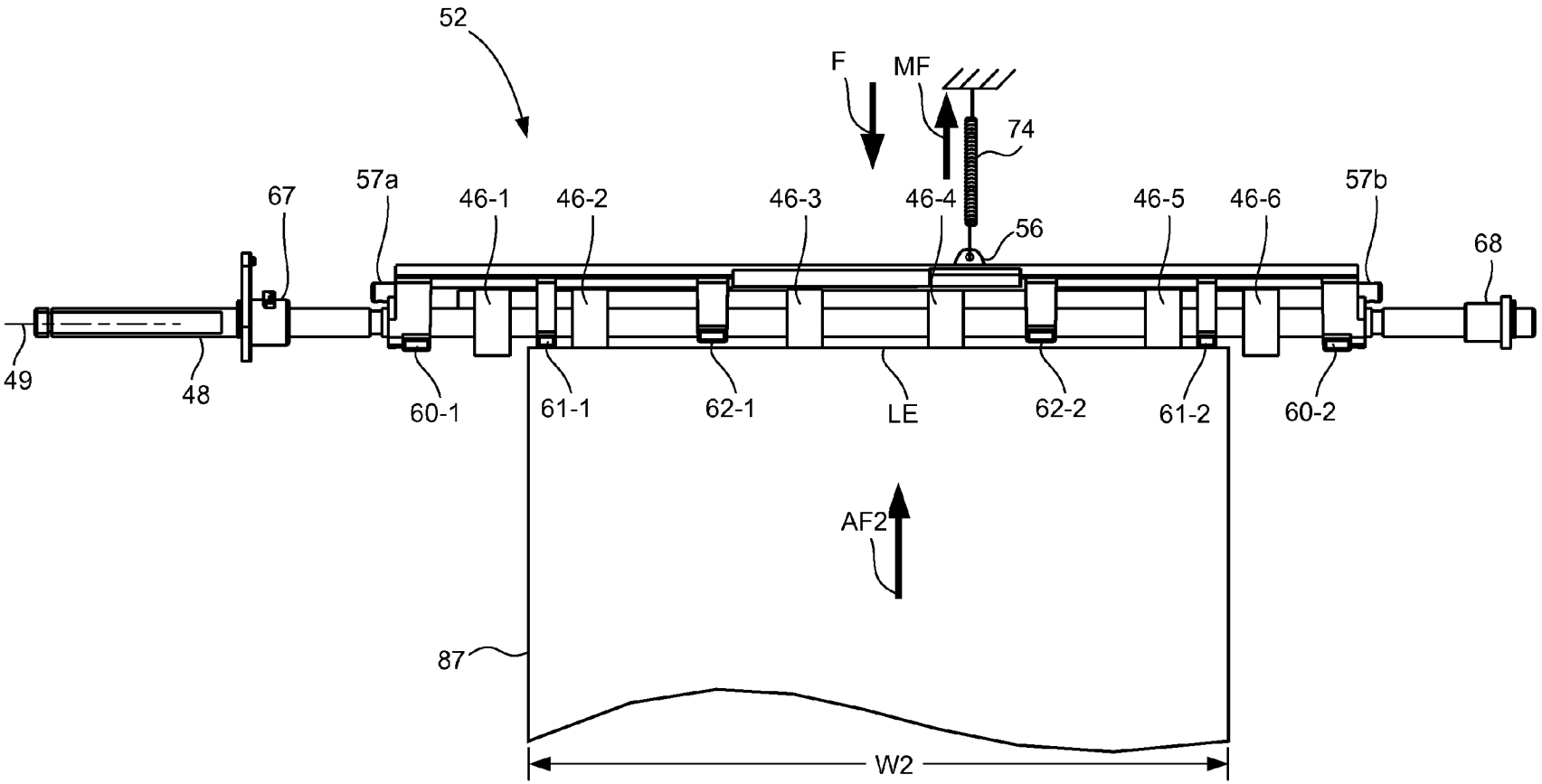
FIG. 7B is a top view of the alignment assembly with the main frame removed, and showing the engagement of the alignment assembly by a mid-width media.

FIG. 7B demonstrates a scenario wherein media sheet 87, having a width W2 in the direction transverse to media feed direction 44, will engage arms 61-1 and 61-2 but not engage arms 60-1, 60-2, 62-1, and 62-2, and must still overcome the force F exerted by the biasing spring 74 in order to deflect alignment assembly 52. W2 is less than distance D1 but greater than distance D2 (see FIG. 2). When media sheet 87 is transported by sheet feed system 18 to engage alignment assembly 52, alignment assembly 52 resists forward conveyance of media sheet 87 in media feed direction 44 until an aligning force AF2 exerted by media sheet 87 overcomes the media engagement force MF exerted by biasing spring 74, at which time, each of the arms 60-1, 60-2, 61-1, 61-2, 62-1 and 62-2 is deflected from the home position 90 to deflected position 95 (shown in FIG. 6) below media feed path 42 to allow narrow media sheet 87 to pass.

Figure 7C:
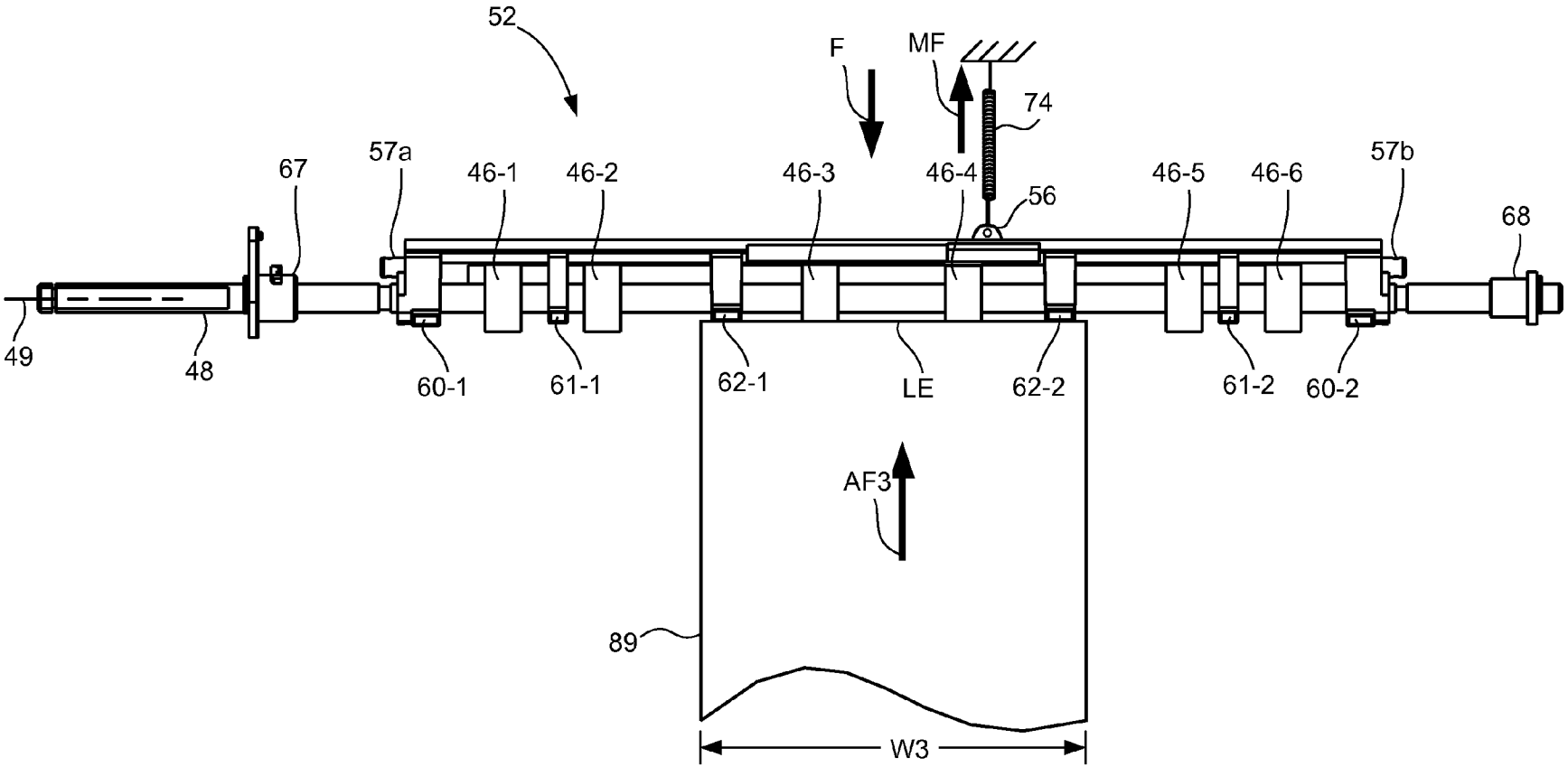
FIG. 7C is a top view of the alignment assembly with the main frame removed, and showing the engagement of the alignment assembly by a narrow width media.

FIG. 7C demonstrates a scenario wherein narrowest media sheet 89, having a width W3 in the direction transverse to media feed direction 44, will engage arms 62-1 and 62-2 but not engage arms 60-1, 60-2, 61-1, and 61-2, and must still overcome the force F exerted by the biasing spring 74 in order to deflect alignment assembly 52. Width W3 is less than distance D2 but greater than distance D3 (see FIG. 2). When narrowest media sheet 89 is transported by sheet feed system 18 to engage alignment assembly 52, alignment assembly 52 resists forward conveyance of narrowest media sheet 89 in media feed direction 44 until an aligning force AF3 exerted by narrowest media sheet 89 overcomes the media engagement force MF exerted by biasing spring 74, at which time, each of the arms 60-1, 60-2, 61-1, 61-2, 62-1 and 62-2 is deflected from the home position 90 to deflected position 95 (shown in FIG. 6) below media feed path 42 to allow narrowest media sheet 89 to pass.

While this invention has been described with respect to embodiments of the invention, the present invention may be further modified within the spirit and scope of this disclosure. While described for used with a printer, the present invention may also be employed for document scanning systems using automated document feeders. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for aligning a media sheet, comprising:

a support;

a sheet feed system for transporting the media sheet along a plane of a media feed path in a media feed direction; and an alignment assembly rotatably coupled to the support and positioned to intersect the media feed path, the alignment assembly applying an aligning force to the media sheet being transported, the alignment assembly comprising:

a deflectable member having a plurality of sets of arms extending therefrom into the plane of the media feed path, each set of arms comprised of at least two spaced apart and aligned arms, each of the at least two arms has a contact surface defining a plane unique to each set of arms wherein contact between each of the at least two arms and the media sheet being transported aligns the media to the plane of the at least two arms; and a biasing member coupled between the deflectable member and the support, the biasing member for providing the aligning force in a direction opposite the media feed direction;

wherein the transported media sheet exerts a media engagement force against the at least two arms of a set, aligning the transported media sheet, and when the media engagement force exceeds the aligning force, the transported media sheet deflects the deflectable member and passes the alignment assembly.

2. The apparatus of claim 1, wherein the deflectable member comprises a first set of arms defining a first plane, and a second set of arms defining a second plane and positioned between the first set of arms wherein the second plane is positioned downstream of the first plane relative to the media feed path.

3. The apparatus of claim 2, wherein the deflectable member further comprises a third set of arms defining a third plane and positioned between the second set of arms, the third plane being positioned downstream of the second plane.

4. The apparatus of claim 2, wherein the sheet feed system is selectable to transport one media sheet having a first width and another media sheet having a second width less than the first width, wherein a spacing between the arms of the first set is selected to be less than the first width of the one media sheet and greater than the second width of the another media sheet, and wherein a spacing between the arms of the second set is selected to be less than the second width of the another media sheet.

5. The apparatus of claim 4, wherein each of the first set of arms is positioned at each end of the first width of the one media sheet, and each of the second set of arms is positioned at each end of the second width of the another media sheet.

6. The apparatus of claim 4, wherein the sheet feed system is further selectable to transport a further media sheet having a third width less than the second width of the other media sheet, wherein a spacing between the arms of the third set is selected to be less than the third width of the further media sheet, and wherein each of the third set of arms is positioned at each end of the third width of the further media sheet.

7. The apparatus of claim 1, wherein the biasing member is coupled at one end approximately midway along a length of the deflectable member and at the other end to the support.

8. An apparatus for aligning a media sheet, comprising:

a support;

a sheet feed system for transporting the media sheet along a plane of a media feed path in a media feed direction; and an alignment assembly rotatably coupled to the support and positioned to intersect the media feed path, the alignment assembly applying an aligning force to the media sheet being transported, the alignment assembly comprising:

a deflectable member, the deflectable member having a plurality of sets of at least one arm extending therefrom into the plane of the media feed path, each set of at least one arm having at least one contact surface defining a plane unique to each set of at least one arm; and a biasing member coupled between the deflectable member and the support, the biasing member for providing the aligning force in a direction opposite the media feed direction;

wherein the transported media sheet exerts a media engagement force against the set of at least one arm, aligning the transported media sheet, and when the media engagement force exceeds the aligning force, the transported media sheet deflects the alignment assembly and passes the alignment assembly.

9. The apparatus of claim 8, wherein the deflectable member has a first set of at least one arm having a first arm and a second arm spaced apart from the first arm, and a second set of at least one arm having a third arm and a fourth arm spaced apart from the third arm, the first arm and the second arm each having a contact surface defining a first plane, the third arm and the fourth arm each having a contact surface defining a second plane, and wherein the second plane is positioned downstream of the first plane relative to the media feed path.

10. The apparatus of claim 9, wherein the third arm and the fourth arm of the second set of at least one arm are positioned between the first arm and the second arm of the first set of at least one arm.

11. The apparatus of claim 10, wherein the deflectable member further comprises a third set of at least one arm having a fifth arm positioned between the third arm and the fourth arm of the second set of at least one arm, the fifth arm having a contact surface defining a third plane, the third plane being positioned downstream of the second plane.

12. The apparatus of claim 11, wherein the deflectable member further comprises a third set of at least one arm having a fifth arm and a sixth arm spaced apart from the fifth arm, the fifth arm and the sixth arm each having a contact surface defining a third plane, the third plane being positioned downstream of the second plane, and wherein the fifth arm and the sixth arm are positioned between the third arm and the fourth arm.

13. The apparatus of claim 11, wherein the sheet feed system is selectable to transport one media sheet having a first width and another media sheet having a second width less than the first width, wherein a spacing between spacing between the first arm and the second arm is selected to be less than the first width of the one media sheet and greater than the second width of the another media sheet, wherein a spacing between the third arm and the fourth arm is selected to be less than the second width of the another media sheet, wherein the first arm and the second arm are positioned at each end of the first width of the one media sheet, and each of the third arm and fourth arm are positioned at each end of the second width of the another media sheet.

14. The apparatus of claim 13, wherein the sheet feed system is further selectable to transport a further media sheet having a third width less than the second width of the other media sheet, wherein a spacing between the fifth arm and the sixth arm is selected to be less than the third width of the further media sheet, and wherein the fifth arm and sixth arm are positioned at each end of the third width of the further media sheet.

15. An imaging apparatus, comprising:

a print engine;

a sheet feed system for transporting the media sheet along a plane of a media feed path in a media feed direction to the print engine, the sheet feed system including a support and a plurality of rollers;

an alignment assembly rotatably mounted to the support, the alignment assembly extending across the media feed path and forming a shallow V with a point of the V in a downstream direction in relation to the media feed path, the alignment assembly comprising a deflectable member having a plurality of pairs of arms spaced apart from one another across the media feed direction, the plurality of arms extending into the plane of the media feed path, wherein an arm of one pair is positioned to align to another arm of the one pair on the opposite side of the V, each of the plurality of pairs of arms defining a unique plane therebetween; and a spring connected to a midpoint of the alignment assembly on one end and a support on another end, the spring for biasing the alignment assembly in a direction counter to the media feed direction;

wherein the transported media sheet exerts a media engagement force against one pair of arms, aligning the transported media sheet, and when the media engagement force exceeds the aligning force, the transported media sheet deflects the deflectable member and passes the alignment assembly.

16. The imaging apparatus of claim 15, wherein the alignment assembly comprises a first pair of arms defining a first plane, and a second pair of arms defining a second plane and positioned between the first pair of arms wherein the second plane is positioned downstream of the first plane relative to the media feed path.

17. The imaging apparatus of claim 16, wherein the sheet feed system is selectable to transport one media sheet having a first width and another media sheet having a second width less than the first width, wherein a spacing between the arms of the first pair is selected to be less than the first width of the one media sheet and greater than the second width of the another media sheet, and wherein a spacing between the arms of the second pair is selected to be less than the second width of the another media sheet.

18. The imaging apparatus of claim 16, wherein the alignment assembly further comprises a third pair of arms positioned between the second pair of arms and defining a third plane, the third plane being positioned downstream of the second plane.

19. The imaging apparatus of claim 18, wherein the sheet feed system is selectable to transport one media sheet having a first width, another media sheet having a second width less than the first width, and a further media sheet having a third width less than the second width of the other media sheet, wherein a spacing between the arms of the first pair is selected to be less than the first width of the one media sheet and greater than the second width of the another media sheet, wherein a spacing between the arms of the second pair is selected to be less than the second width of the another media sheet, and wherein a spacing between the arms of the third pair of arms is selected to be less than the third width of the further media sheet.

20. The imaging apparatus of claim 19, wherein each of the first pair of arms is positioned at each end of the first width of the one media sheet, each of the second pair of arms is positioned at each end of the second width of the another media sheet, and each of the third pair of arms is positioned at each end of the third width of the further media sheet.

* * * * *